US008391521B2

(12) United States Patent
Takumai

(10) Patent No.: US 8,391,521 B2
(45) Date of Patent: Mar. 5, 2013

(54) AUDIO REPRODUCTION APPARATUS AND METHOD

(75) Inventor: Susumu Takumai, Hamamatsu (JP)

(73) Assignee: Yamaha Corporation (JP)

( * ) Notice: Subject to any disclaimer, the term of this patent is extended or adjusted under 35 U.S.C. 154(b) by 1093 days.

(21) Appl. No.: 11/574,248

(22) PCT Filed: Aug. 26, 2005

(86) PCT No.: PCT/JP2005/015562

§ 371 (c)(1),
(2), (4) Date: Feb. 25, 2007

(87) PCT Pub. No.: WO2006/022380

PCT Pub. Date: Mar. 2, 2006

(65) Prior Publication Data

US 2007/0217621 A1 Sep. 20, 2007

(30) Foreign Application Priority Data

Aug. 26, 2004 (JP) ..... 2004-246963

(51) Int. Cl.
*H04R 5/02* (2006.01)
*H04R 5/00* (2006.01)

(52) U.S. Cl. ..... 381/307; 381/17; 381/310; 381/300; 381/27

(58) Field of Classification Search ..... 381/17–19, 381/307, 310, 300, 1, 27
See application file for complete search history.

(56) References Cited

U.S. PATENT DOCUMENTS 3,772,479 A 11/1973 Hilbert
4,024,344 A 5/1977 Dolby et al.
4,118,601 A 10/1978 Yeap
4,227,160 A 10/1980 Tamori et al.
4,472,834 A 9/1984 Yamamuro et al.
4,503,553 A 3/1985 Davis
4,984,273 A 1/1991 Aylward et al.
4,991,687 A 2/1991 Oyaba et al.
5,109,419 A 4/1992 Griesinger (Continued)

FOREIGN PATENT DOCUMENTS

CA 2107320 C 3/1997
CN 1200639 A 12/1998

(Continued)

OTHER PUBLICATIONS

Relevant portion of International Search Report for international application No. PCT/JP2005/015562; mailing date of Dec. 13, 2005.

(Continued)

*Primary Examiner* — Xu Mei
(74) *Attorney, Agent, or Firm* — Rossi, Kimms & McDowell LLP

(57) ABSTRACT

In a system capable of outputting an audio signal as beams from an array speaker and performing multi-channel reproduction, a plurality of beam setting patterns (reproduction modes) are stored in the memory of a controller. The beam setting patterns include a single basic pattern and a plurality of deformed patterns that use the beam control data of the basic pattern. When the user specifies a reproduction mode via an interface, the beam setting pattern corresponding to the mode is read and set to the signal processor of each channel.

10 Claims, 5 Drawing Sheets

U.S. PATENT DOCUMENTS

| | | | | |
|---|---|---|---|---|
| 5,233,664 | A | 8/1993 | Yanagawa et al. | |
| 5,524,054 | A | 6/1996 | Spille | |
| 5,631,714 | A | 5/1997 | Saadoun | |
| 5,666,424 | A | 9/1997 | Fosgate et al. | |
| 5,675,655 | A | 10/1997 | Hatae | |
| 5,930,373 | A | 7/1999 | Shashoua et al. | |
| 5,953,432 | A | 9/1999 | Yanagawa et al. | |
| 6,005,948 | A | 12/1999 | Maeda | |
| 6,128,395 | A | 10/2000 | DeVries | |
| 6,181,796 | B1 | 1/2001 | Johnson | |
| 6,240,189 | B1 | 5/2001 | Aylward | |
| 6,285,891 | B1 | 9/2001 | Hoshino | |
| 6,498,852 | B2 | 12/2002 | Grimani | |
| 6,535,610 | B1 | 3/2003 | Stewart | |
| 6,804,361 | B2 | 10/2004 | Hosoi et al. | |
| 7,054,448 | B2 | 5/2006 | Yoshino et al. | |
| 7,319,641 | B2 * | 1/2008 | Goudie et al. | 367/138 |
| 7,515,719 | B2 | 4/2009 | Hooley et al. | |
| 7,720,237 | B2 | 5/2010 | Bharitkar et al. | |
| 7,822,496 | B2 | 10/2010 | Asada et al. | |
| 7,826,626 | B2 | 11/2010 | Bharitkar et al. | |
| RE42,390 | E | 5/2011 | Hosoi et al. | |
| 2001/0016047 | A1 | 8/2001 | Ohta | |
| 2002/0191807 | A1 | 12/2002 | Asada et al. | |
| 2003/0185404 | A1 | 10/2003 | Milsap | |
| 2004/0071299 | A1 | 4/2004 | Yoshino | |
| 2004/0151325 | A1 | 8/2004 | Hooley et al. | |
| 2004/0193050 | A1 * | 9/2004 | Ogawa | 600/438 |
| 2004/0252844 | A1 | 12/2004 | Christensen et al. | |
| 2005/0089182 | A1 | 4/2005 | Troughton et al. | |
| 2005/0271230 | A1 | 12/2005 | Sasaki | |
| 2006/0050897 | A1 | 3/2006 | Asada et al. | |
| 2006/0153391 | A1 | 7/2006 | Hooley et al. | |
| 2006/0204022 | A1 | 9/2006 | Hooley et al. | |
| 2006/0233378 | A1 | 10/2006 | Kim et al. | |
| 2007/0076905 | A1 | 4/2007 | Konagai et al. | |
| 2007/0165878 | A1 | 7/2007 | Konagai | |
| 2007/0217621 | A1 | 9/2007 | Takumai | |
| 2008/0159545 | A1 | 7/2008 | Takumai et al. | |
| 2008/0159566 | A1 | 7/2008 | Konagai et al. | |
| 2008/0226093 | A1 | 9/2008 | Kushida et al. | |
| 2009/0060237 | A1 | 3/2009 | Konagai | |
| 2009/0225992 | A1 | 9/2009 | Konagai | |
| 2009/0296943 | A1 | 12/2009 | Martin | |

FOREIGN PATENT DOCUMENTS

| | | | |
|---|---|---|---|
| CN | 1754403 | A | 3/2006 |
| DE | 1762735 | | 10/1970 |
| DE | 27 290 51 | A1 | 1/1979 |
| GB | 1122851 | | 8/1968 |
| GB | 2273848 | A | 6/1994 |
| GB | 2373956 | A | 10/2002 |
| JP | 05-041897 | A | 2/1993 |
| JP | 5-091589 | A | 4/1993 |
| JP | 5276591 | A | 10/1993 |
| JP | 6-38289 | A | 2/1994 |
| JP | 06062488 | A | 3/1994 |
| JP | 6-205496 | A | 7/1994 |
| JP | 06-205496 | A | 7/1994 |
| JP | 6209500 | A | 7/1994 |
| JP | 06-225379 | A | 8/1994 |
| JP | 6261385 | A | 9/1994 |
| JP | 6269096 | A | 9/1994 |
| JP | 9-121400 | A | 6/1997 |
| JP | 9233591 | A | 9/1997 |
| JP | 09-259539 | A | 10/1997 |
| JP | 9-259539 | A | 10/1997 |
| JP | 11027604 | A | 1/1999 |
| JP | 11-136788 | A | 5/1999 |
| JP | 2001-025084 | A | 5/1999 |
| JP | 11-69474 | A | 9/1999 |
| JP | 2000-184488 | A | 6/2000 |
| JP | 2001-128279 | A | 5/2001 |
| JP | 2001-346297 | A | 12/2001 |
| JP | 2002-345077 | A | 11/2002 |
| JP | 2003023689 | A | 1/2003 |
| JP | 2003-510924 | A | 3/2003 |
| JP | 2003-230071 | A | 8/2003 |
| JP | 2004172661 | A | 6/2004 |
| JP | 2004172703 | A | 6/2004 |
| JP | 2004186895 | A | 7/2004 |
| JP | 2004193698 | A | 7/2004 |
| JP | 2004-531125 | A | 10/2004 |
| JP | 2004336530 | A | 11/2004 |
| JP | 2004-349795 | A | 12/2004 |
| JP | 2004-363695 | A | 12/2004 |
| JP | 2004350173 | A | 12/2004 |
| JP | 2004363697 | A | 12/2004 |
| JP | 2005012765 | A | 1/2005 |
| JP | 2005027020 | A | 1/2005 |
| JP | 2006238155 | A | 2/2005 |
| JP | 2005080079 | A | 3/2005 |
| JP | 2006319390 | A | 5/2005 |
| JP | 2006-067301 | A | 3/2006 |
| JP | 2006-518956 | A | 8/2006 |
| JP | 2006-304128 | A | 11/2006 |
| WO | 99/08479 | | 2/1999 |
| WO | 01-23104 | A2 | 4/2001 |
| WO | 0278388 | A2 | 3/2002 |
| WO | 03071827 | A2 | 8/2003 |
| WO | 2004047490 | A1 | 6/2004 |
| WO | 2004066673 | A1 | 8/2004 |
| WO | 2004075601 | A1 | 9/2004 |
| WO | 2005/015956 | A1 | 2/2005 |

OTHER PUBLICATIONS

Notice of Reasons for Rejection issued in Japanese Patent Application No. 2004-246963, from which this application claims foreign priority, dated Jun. 6, 2006.

Chinese Office Action dated Apr. 3, 2009, issued in corresponding Chinese Application No. 2005800287301.

Supplementary European Search Report issued Sep. 25, 2009 in corresponding European Patent Appln No. 05774560.6 (Full Translation).

Supplementary European Search Report cited in co-pending U.S. Appl. No. 10/585,269 which corresponds to EP 05703397.9-225 dated Aug. 6, 2007.

Meyer, David G.; "Digital Control of Loudspeaker Array Directivity"; Journal of the Audio Engineering Society; Oct. 1984; pp. 747-754; vol. 32-No. 12; New York, USA. Cited in co-pending U.S. Appl. No. 10/585,269.

International Search Report cited in co-pending U.S. Appl. No. 10/585,269 which corresponds to PCT/JP2004/019736 dated Apr. 19, 2005.

Notification of Reasons for Refusal cited in co-pending U.S. Appl. No. 10/585,269 which corresponds to JP 2004-000675, dated Sep. 25, 2007.

Notification of Reasons for Refusal cited in co-pending U.S. Appl. No. 10/585,269 which corresponds to JP 2004-000675, dated Feb. 19, 2008.

Decision of Refusal cited in co-pending U.S. Appl. No. 10/585,269 which corresponds to 2004-000675, dated May 20, 2008.

Notification of Reason for Refusal cited in co-pending U.S. Appl. No. 10/585,269 which corresponds to JP 2003-429819, dated Apr. 8, 2008.

Notification of Reason for Refusal cited in co-pending U.S. Appl. No. 10/585,655 which corresponds to JP 2004-002511, dated Jan. 22, 2008.

Notification of Reason for Refusal cited in co-pending U.S. Appl. No. 10/585,655 which corresponds to 2004-002511, dated Aug. 26, 2008.

International Search Report cited in co-pending U.S. Appl. No. 11/817,074 which corresponds to PCT/JP2006/303319 dated May 16, 2006.

Notification of the First Office Action cited in co-pending U.S. Appl. No. 11/817,074 which corresponds to CN 2006800060275, Issued May 8, 2009.

Notification of Reason for Refusal cited in co-pending U.S. Appl. No. 12/044,603, which corresponds to EP 08003945.6-2225, dated Jul. 7, 2008. English language translation provided.

Notification of Reason for Refusal cited in co-pending U.S. Appl. No. 11/817,074 which corresponds JP 2005-051099 dated Sep. 7, 2010.

International Search Report dated Apr. 19, 2005 from PCT/JP2005/00158. Cited in U.S. Appl. No. 10/585,269.
International Search Report dated Apr. 19, 2005 from PCT/JP2005/000159. Cited in U.S. Appl. No. 10/585,654.
International Search Report dated Apr. 19, 2005 from PCT/JP2005/000157. Cited in U.S. Appl. No. 10/585,655.
Notification of Reasons for Refusal dated Oct. 2, 2007 from JP 2004-000675. Cited in U.S. Appl. No. 10/585,269.
Notification of Reasons for Refusal dated Mar. 18, 2008 from JP 2004-002512. Cited in U.S. Appl. No. 10/585,654.
Supplementary European Search Report dated Aug. 8, 2007 from EP 05703398.7. Cited in U.S. Appl. No. 10/585,654.
Supplementary European Search Report dated Sep. 29, 2009 from EP 04808086.5, which corresponds to U.S. Appl. No. 10/585,269.
Supplementary European Search Report dated Jun. 25, 2010 from EP 05703396.1, which corresponds to U.S. Appl. No. 10/585,655.
"Wideband Beamforming by Means of Multiple Band-Division Using Dolph-Chebyshev Spatial Filters"; Journal of Institute of Electronics, Information and Communication Engineers; Dec. 1995; vol. J78-A. Cited in U.S. Appl. No. 12/044,603.
Ohya et al; "Directional Array Speakers with the Specified Beam Direction by means of a Band-Division Design"; 10th Digital Signal Processing Symposium; Nov. 1-2, 1995. Cited in U.S. Appl. No. 12/044,603.

* cited by examiner

FIG. 4

(BASIC MODE)

| PARAMETER | CH | MODE 1 5ch A | MODE 2 5ch B | MODE 3 3ch A | MODE 4 3ch B | MODE 5 2ch |
|---|---|---|---|---|---|---|
| BEAM ANGLE, FOCAL DISTANCE, FOCAL PATH DISTANCE, REPRODUCTION LEVEL | FL | FL | C (+α)/Fix | FL | C (+α)/Fix | C (+α)/Fix |
| | FR | FR | C (+α)/Fix | FR | C (+α)/Fix | C (+α)/Fix |
| | SL | SL | FL | FL | C (+α)/Fix | ↑ |
| | SR | SR | FR | FR | C (+α)/Fix | ↑ |
| | C | C | C | C | C | ↑ |

AUDIO REPRODUCTION APPARATUS AND METHOD

TECHNICAL FIELD

The present invention relates to audio reproduction apparatus for reproducing a multi-channel audio signal by using an array speaker.

BACKGROUND ART

As apparatus for reproducing a multi-channel audio signal, a real multi-speaker system where a plurality of (for example six) speakers are installed has been in practical use.

In recent years, apparatus has been proposed to reproduce multi-channel audio by outputting an audio signal as beams by using a single array speaker (for example, refer to JP-T-2003-510924). The apparatus described in JP-T-2003-510924 inputs the same audio signal into the speaker units at the same time or with slightly shifted timings to output the audio signal in a beam shape based on the principle of superposition. That is, as shown in FIG. 2, by inputting an audio signal into speaker units with timings slightly shifted from each other, audio beams are formed in oblique direction. By appropriately setting the timing shift (delay time), it is possible to control the directivity in a desired direction to form audio beans.

DISCLOSURE OF THE INVENTION

By taking advantage of this property of the array speaker, an audio signal of each channel is output as beams in separate directions for example as shown in FIG. 3A by appropriately setting the delay time of an audio signal of each channel of a multi-channel audio signal.

In the example of FIG. 3A, a center channel C (or audio signal thereof; and so on) is directly output to a front listener. A front left channel FL and a front right channel FR are reflected once on side walls and reach the listener. A surround left channel SL and a surround right channel SR are reflected on side walls and rear walls, twice in total, and reach the listener. The listener hears the audio signals of these channels as if they were arriving from different directions, thereby reproducing the multi-channel audio.

Multi-channel contents include movies of various genres and concert video films, the user may desire different spread of a sound image depending on the type of content. For example, in the case of a large-scale movie, the sound image is preferably enhanced to surround a listener. In the case of a concert or a drama involving numerous lines, the sound image is preferably centered for a listener to hear the sound directly from the front.

According to a related real multi-speaker system, speaker units are installed in predetermined positions and modification to a sound image is made using a decider or via post-processing.

A system using an array speaker is capable of forming virtual speakers on the walls of a room by way of beam control. The virtual speakers, when their parameters are changed, provide simply an effect corresponding to change in the speaker positions that is difficult in a real speaker configuration. This characteristic can be used as a variable function of a sound image inherent to an array speaker. To provide this function, it is necessary to make beam control of beam setting of each channel to its sound image (reproduction form) with unusual parameters. To this end, it is necessary to provide different parameters for respective reproduction forms. Calculating the parameters required each time the reproduction form is changed takes a longer processing time. In case the parameters for all reproduction forms at initial setting increases the data amount to be stored and managed.

An object of the invention is to provide audio reproduction apparatus capable of changing the beam setting with a simple configuration in the reproduction of a multi-channel audio signal by way of audio beams using an array speaker.

MEANS FOR SOLVING THE PROBLEM

The invention provides audio reproduction apparatus comprising: an array speaker including a plurality of speaker units in a matrix or line arrangement; a directivity control controller that controls the directivity of an audio signal of each channel in art independent direction of each other based on the directivity control data set to each channel; a directivity control data storage that stores the directivity control data for each channel; a pattern storage that stores a basic pattern of assigning the directivity control data for each channel to a corresponding channel and a deformed pattern of assigning directivity control data for different channels to some or all of the channels; a pattern selector that selects the basic pattern or deformed pattern; and a controller that sets directivity control data to the directivity controller based on the pattern selected by the pattern selector.

The invention provides a directivity control method for audio reproduction apparatus comprising: an array speaker including a plurality of speaker units in a matrix or line arrangement; and a directivity controller for storing center channel directivity control data for controlling the directivity of an audio signal so as to cause the audio signal to be output toward a listening position, front channel directivity control data for controlling the directivity of an audio signal so as to cause the audio signal to be reflected on a left side wall or a right side wall and reach the listening position, and surround channel directivity control data for controlling the directivity of an audio signal so as to cause the audio signal to be reflected on a left side wall or a right side wall and a rear wall and reach the listening position and independently controlling the directivity of each of the multi-channel audio signals and inputting the audio signals to an array speaker, characterized in that the method controls the directivity of a center channel audio signal by using the center channel directivity control data, controls the directivity of a front channel audio signal by using the center channel directivity control data or a preset fixed value, and controls the directivity of a surround channel audio signal by using the front channel directivity control data.

The invention provides a directivity control method for audio reproduction apparatus comprising an array speaker including a plurality of speaker units in a matrix or line arrangement; and a directivity controller for storing center channel directivity control data for controlling the directivity of an audio signal so as to cause the audio signal to be output toward a listening position, front channel directivity control data for controlling the directivity of an audio signal so as to cause the audio signal to be reflected on a left side wall or a right side wall and reach the listening position, and surround channel directivity control data for controlling the directivity of an audio signal so as to cause the audio signal to be reflected on a left side wall or a right side wall and a rear wall and reach the listening position, and independently controlling the directivity of each of the multi-channel audio signals and inputting the audio signals to an array speaker, characterized in that the method controls the directivity of a center channel audio signal by using the center channel directivity control data, controls the directivity of a front channel audio signal by using the front channel directivity control data, and controls the directivity of a surround channel audio signal by using the front channel directivity control data.

The invention provides a directivity control method for audio reproduction apparatus comprising: an array speaker including a plurality of speaker units in a matrix or line arrangement; and a directivity controller for storing center channel directivity control data for controlling the directivity of an audio signal so as to cause the audio signal to be output toward a listening position, front channel directivity control data for controlling the directivity of an audio signal so as to cause the audio signal to be reflected on a left side wall or a right side wall and reach the listening position, and surround channel directivity control data for controlling the directivity of an audio signal so as to cause the audio signal to be reflected on a left side wall or a right side wall and a rear wall and reach the listening position, and independently controlling the directivity of each of the multi-channel audio signals and inputting the studio signals to an array speaker, characterized in that the method controls the directivity of a center channel audio signal by using the center channel directivity control data, controls the directivity of a front channel audio signal and a surround channel audio signal by using the center channel directivity control data or a preset fixed value.

the invention provides a directivity control method for audio reproduction apparatus comprising: an array speaker including a plurality of speaker units in a matrix or line arrangement; and a directivity controller for storing center channel directivity control data for controlling the directivity of an audio signal so as to cause the audio signal to be output toward a listening position, front channel directivity control data for controlling the directivity of an audio signal so as to cause the audio signal to be reflected on a left side wall or a right side wall and reach the listening position, and surround channel directivity control data for controlling the directivity of an audio signal so as to cause the audio signal to be reflected on a left side wall or a right side wall and a rear wall and reach the listening position, and independently controlling the directivity of each of the multi-channel audio signals and inputting the audio signals to an array speaker, characterized in that the method mixes down the directivity of a center channel audio signal and a surround channel audio signal to 2-channel audio signals of the front channel and controls the directivity of the mixed-down audio signals by using the center channel directivity control data or a preset fixed value.

According to the invention, it is possible to control the directivity to reproduce multi-channel audio signals. In the normal node, for examples basic directivity control pattern that the front left and right channels (or audio signals thereof) are reflected once on the left and right walls and reach the listener, the surround left and right channels are reflected on the left and right walls and the rear wall and reach the listener and the center channel directly reaches the listener is used to output multi-channel audio signals.

By changing the directivity pattern from the basic pattern, it is possible to change the localization of each channel to change the spread of the sound image. For example, it is possible to control the front left and right channels by using the directivity cool data of the center channel and control the surround left and right channels by using the directivity control data of the front left and right channel. With this approach, it is possible to control the directivity to a different pattern by using the directivity control data of the basic pattern without calculating or storing new directivity control data.

The directivity control pattern (beam setting pattern) corresponds to the speaker locations in a real multi-speaker system. The directivity control pattern can be changed by simply changing the directivity control data to be set to each channel. Thus, the user has only to change the setting to content to be reproduced or a reproduction environment in order to obtain the effect of changing the speaker locations in a real time. For example, a plurality of directivity control patterns may be previously stored in a table and allowing selection of a setting pattern by using buttons on a remote control makes it easier for the user to change setting.

According to the invention, a set of basic directivity control data is used for other channels to create a plurality of directivity control patterns and each of the patterns is made selectable as a reproduction mode. The user thus need not create a desired mode thereby facilitating the setting procedure. The data to be stored and managed is minimized so that the storage area and data processing load are reduced and the system design process is simplified.

BRIEF DESCRIPTION OF THE DRAWINGS

FIG. 4 shows a pattern table storing a plurality of beam setting patterns.

BEST MODE FOR CARRYING OUT THE INVENTION

The multi-channel audio system as an embodiment of the invention will be described referring to drawings. This audio system outputs the audio signal of each channel of 5-channel audio signals in beams by using a single array speaker thus performing surround reproduction of sound without installing a five-speaker systems. As patterns of directivity control (beam setting) of each channel, a single basic pattern (5-channel A: refer to FIG. 3A) and four deformed patterns using the beam control data of the basic pattern (refer to FIGS. 3B-3E) are stored in a table (refer to FIG. 4).

Figure 1A:
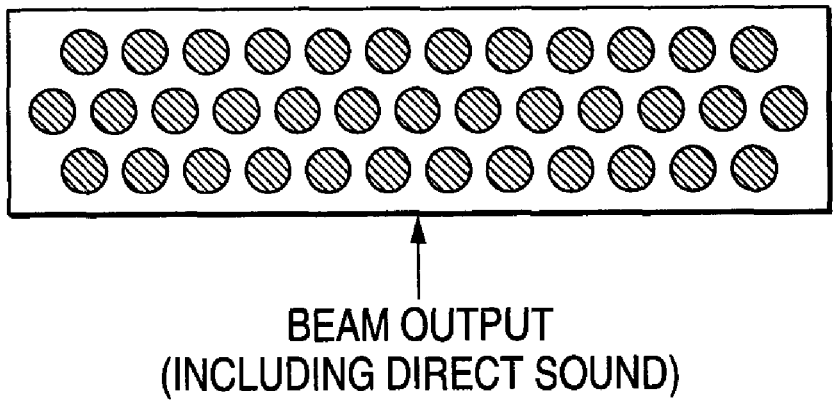
FIG. 1 shows the configuration of an array speaker used for a multi-channel audio system as an embodiment of the invention.

The array speaker shown in FIG. 1 is a line array speaker system including a honeycomb-shaped array of small speakers (speaker units). The array speaker is not limited to one shown in FIG. 1 but may use a plurality of speaker units arranged in a line or matrix arrangement.

In such an array speaker, by outputting the same audio signal from each speaker unit and adjusting the output timing for each speaker unit so that the audio signals will reach a predetermined point (focus) in a space at the same time, it is possible to output audio signals in the shape of beams having a directivity in the direction of the focus byway of the principle of superposing.

Timing control of an audio signal of each channel of the multi-channel audio signals is made and the audio signal is input to the array speaker so that the signal will be beamed in a different direction. In this practice, the audio signals of the channels are input in a superposing fashion. The audio signals of the channels are blamed and propagated in separate directions without being overlaid one on another and impinge from separate directions with respect to the listener.

Control of the beam direction requires parameters (beam control data) such as tap data (delay data) used to control the output timing to each speaker unit based on a path length (focal length) and a focus direction (beam angle) a gain correction value used to set a gain to be input to a gain multiplier for compensating for attenuation caused by reflections, and equalization data used to set an equalizer for compensating for variations in sound quality caused by the beam angle or material of reflective walls. Beam control data for each channel shown in FIG. 3A (center channel beam control data, front left channel beam control data, front right channel beam control data, surround left channels beam control data, and surround right channel beam control data) is stored in the memory 11 (refer to FIG. 5).

Figure 3A:
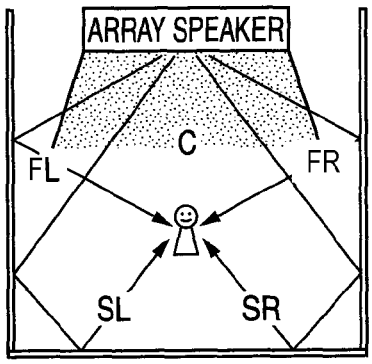
FIG. 3 illustrates the beam setting patterns in a multi-channel audio system.

The beam setting pattern shown in FIG. 3A is the basic form (basic pattern) of multi-channel reproduction by an array speaker. This example uses a rectangular room close to a square in vertical orientation and arranges an array speaker in the center of the room. In this room shape, audio signals of the channels are output as follows. A channel C (or audio signal thereof; and so on) is directly output toward a front listener. The center channel C may be beamed or not beams. A front left channel FL and a front right channel FR are beams so that they will be reflected once on side walls and reach the listener. A surround left channel SL and a surround right channel SR are beamed so that they will be reflected on side walls and rear walls, twice in total, and reach the listener. The listener hears the sound as if the center channel C were coming from the front, the front left channel FL and the front right channel FR were coming from the left/right oblique front, and the surround left channel SL and the surround right channel SL were coming from the left/right oblique rear. This provides virtual multi-channel audio reproduction.

This multi-channel audio system is capable of reproducing the audio signal of each channel in one of the deformed beam setting patterns shown in FIGS. 3B, 3C, 3D, and 3E by using the beam control data used for the basic pattern shown in FIG. 3A.

The beam setting patterns shown in FIGS. 3A to 3E are registered in the pattern table shown in FIG. 4. The pattern table is written into the memory of the controller.

In the pattern table shown in FIG. 4, Mode 1 is a basic pattern (5-channel A) shown in FIG. 3A. This pattern is a basic pattern that simulates a real multi-speaker system in an ideal environment including left and right side walls and a rear wall to reflect sound.

Figure 1B:
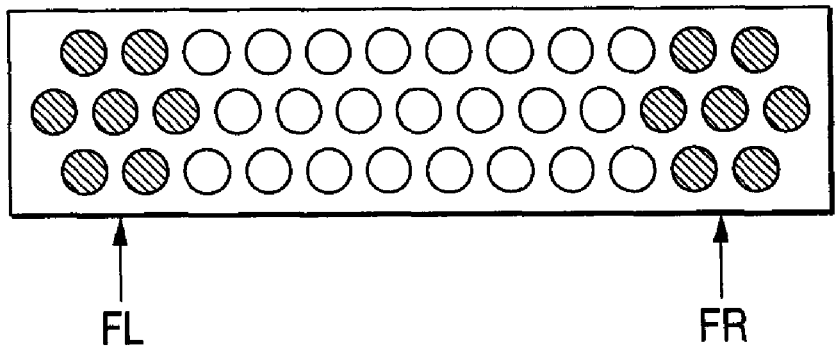
Figure 2:
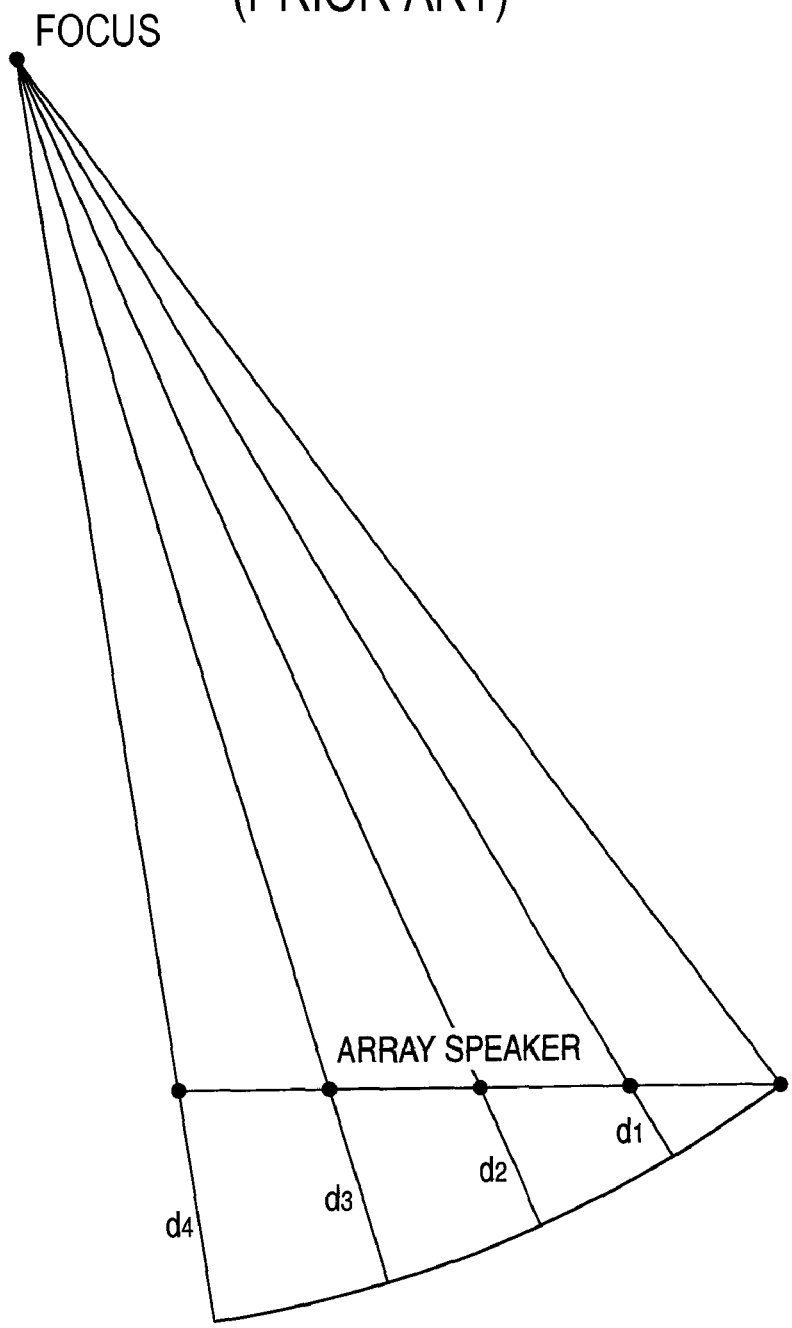
FIG. 2 (PRIOR ART)
FIG. 2 illustrates the principle of beaming of an audio signal by using an array speaker.
Figure 3B:
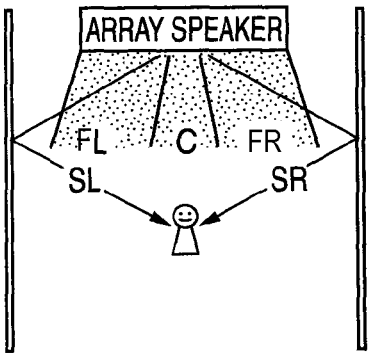

Mode 2 is a 5-channel B pattern shown in FIG. 3B. In this pattern, the front left and right channels FL, FR are directly output as sound toward the listener by using the beam control data of the center channel of the basic pattern or a preset fixed value and the surround left and right channels SL, SR are output by using the beam control data of the front left and right channels of the basic pattern go that they will be reflected once on side walls and reach the listener. The audio signal of the front channel is output from speaker units in part of the left and right areas of the array speaker as shown in FIG. 1B in order to avoid hearing. To this end, the output level is increased by $+\alpha$ with respect to the level setting value of the center channel.

This deformed pattern is preferred in case rear reflection is unavailable such as when a rear wall is not provided, in case the front channel is spread excessively in the standard pattern, or in case sound such as music content from the rear is unnatural.

Figure 3C:
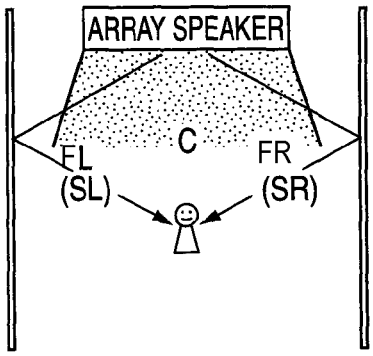

Mode 3 is a 3-channel A pattern shown in FIG. 3C. In this deformed pattern, the front left and right channels FL, FR and the center channel C are controlled using the beam control data in accordance with the basic pattern and the surround left and right channels SL, SR are output, by using the beam control data of the front left and right channels of the basic pattern so that they will be reflected once on side walls and reach the listener. The audio signal of the front channel is output from speaker units in left and right partial areas of the array speaker as shown in FIG. 1B in order to avoid beaming. To this end, the output level is increased by $+\alpha$ with respect to the level setting value of the canter channel. This deformed pattern is preferred in case rear reflection is unavailable such as when a rear wall is not provided and the spreading sense of a sound image is desired.

Figure 3D:
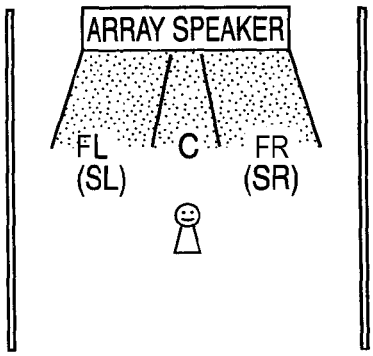

Mode 4 is a 3-channel B pattern shown in FIG. 3D. In this deformed pattern, the front left and right channels FL, FR and the surround left and right channels SL, SR are directly output toward the listener by using the beam control data of the center channel of the basic pattern or a preset fixed value. This deformed pattern is preferred in an environment where reflections are not available at all or in case lines in a drama need more clarity.

Figure 3E:
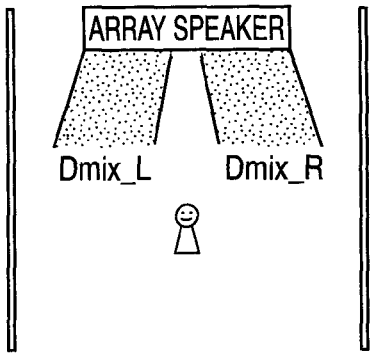

Mode 5 is a 2-channel pattern shown in FIG. 3E. In this deformed pattern, the center channel C and the surround channels SL, SR are mixed down to the front left and right channels FL, FR by using a decoder and the mixed-down front left and right channels FL, FR are directly output as sound from the speaker units in part of the left and right areas of the array speaker toward the listener by using the beam control data of the center channel of the basic pattern or a preset fixed value. This deformed pattern is preferred when the array speaker is to be used as normal stereo speaker system such as in viewing a TV or in an environment where reflections are not available at all.

Selection of a mode (beam setting pattern) is not limited to the foregoing preferred conditions but at the discretion of the user irrespective of the target content or use environment.

Figure 5:
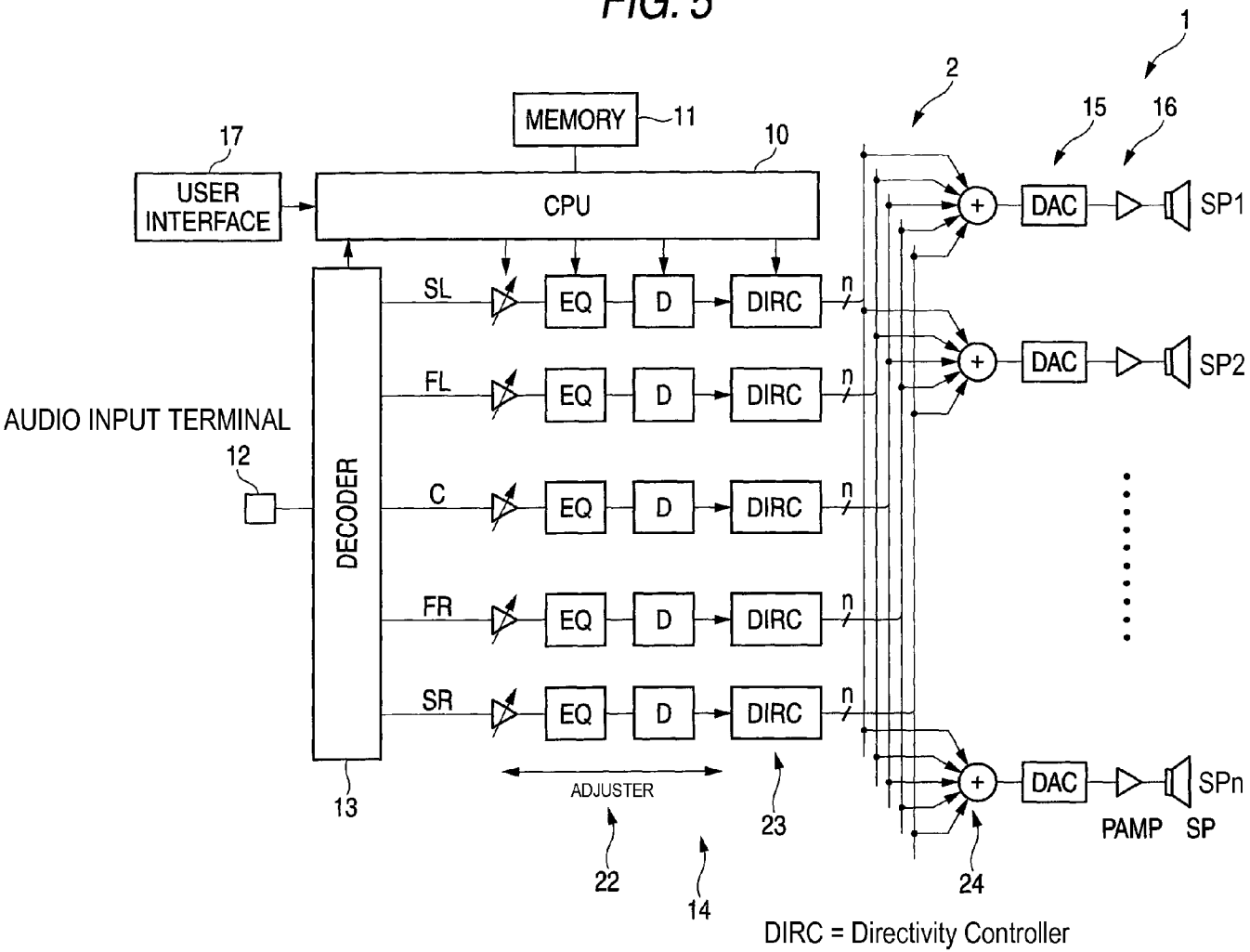
FIG. 5 is a block diagram of the multi-channel audio system.

FIG. 5 is a block diagram of the multi-channel audio system. The audio system is composed of an array speaker 1 and a circuit 2. The array speaker 1 includes speaker units SP1-SPn arranged as shown in FIG. 1 and is accommodated in a housing (speaker box). The circuit 2 may be accommodated integrally with the array speaker 1 in the cabinet or separately provided.

The circuit 2 includes a controller 10, a pattern memory 11, a decoder 13, a signal processor 14, an amplifier 16, and a user interface 17.

The decoder 13 that is connected to a digital audio input terminal 12 decodes a digital audio data input from the digital audio input terminal 12 to multi-channel audio signals. In this embodiment, the resulting signals are 5-channel audio signals. The 5-channel audio signals obtained by decoding (center C, front left FL, front right FR, surround left SL and surround right SR) are input to the signal processor 14. Depending on the reproduction mode, audio signals the center C, surround left SL and surround right SR are mixed down to the front left FL and the front right FR and output.

The signal processor 14 includes signal processors 14FL, 14FR, 14SL, 14SR, 14C separately provided for audio channels and adders 24 for speaker units. Each signal processor is composed of an adjuster (ADJ) 22 and a directivity controller (Dirc) 23. The signal processor is composed of a DSP and its functional parts are composed of micro-programs.

The adjuster 22 is a functional part for compensating for variations in the sound volume and sound quality attributable to the path length of separate beans and number of reflections of the audio signal of each channel output from the decoder 13. The adjuster 22 includes a gain factor multiplier, an equalizer and a delay part. The gain factor multiplier multiplies an audio signal by a gain factor in order to compensate for attenuation caused by the distance traveled by beams to reach the listener and the number of reflections. The equalizer adjusts the gain per frequency band in order to compensate for high-range attenuation caused by the frequency response of the speaker unit of the array speaker 1 and reflections on walls. The delay part is a functional part for delaying beams depending on the distance separate beams (including direct sound) travel until they reach the listener in order to compensate for differences in the time of arrival at the listener caused by differences in the beam path length.

The directivity controller 23 is a functional part for controlling the timing with which an audio signal is output to each speaker unit as beams directed to a predetermined focus. This functional part is implemented for example by providing a shift register with output taps for respective speaker units, The audio signals destined to the speaker units output from the directivity controller 23 are synthesized for each speaker unit and converted to an analog signal in a D/A converter 15, then input to the a power amplifier 15. The power amplifier 16 amplifies the audio signal and inputs the resulting signal to each speaker unit of the array speaker 1. Each speaker unit radiates this audio signal as aerial vibration.

The controller 10 controls the signal processor 14 based on the beam control data stored in the memory 11 and the pattern table (refer to FIG. 4).

The controller 10 reads the beam setting pattern of a reproduction mode corresponding to the reproduction mode instructed by the user (listener) via the user interface 17 and determines the beam control data to set to the signal processor of each channel.

The controller 10 reads the beam control data from the memory 11 and sets the adjuster 22 and the directivity controller 23 to predetermined functions by using the beam control data. To be more precise, the controller 10 set predetermined parameters to the gain factor multiplier, equalizer and delay part of the adjuster 22 as well as sets an output tap suited for the beam direction and focal length to the directivity controller 23.

The user interface 17 includes an infrared remote control unit equipped with button switches (reproduction mode selector buttons) for selecting the reproduction modes. When the user presses any of the reproduction mode selector buttons, the operation information is transmitted to the controller, which immediately switches between beam setting patterns even while content is being reproduced.

While the beam control data of one channel is set to the signal processor of the other channel in case audio signals of plural channels are reproduced with the same beam setting (for example, refer to the front left channel FL and the surround left channel SL in Mode 3 shown in FIG. 3C), the audio signal of the other channel may be mixed down to the audio signal of one channel.

In case it is possible to acquire the type and genre of a reproduced content, a corresponding reproduction mode may be automatically selected.

The invention claimed is:

1. An audio reproduction apparatus comprising:

an array speaker including a plurality of speaker units in a matrix or line arrangement;

a directivity controller that controls directivity of an audio signal of each channel of input multi-channel audio signals in an independent direction of each other based on directivity control data set to each channel;

a directivity control data storage device that stores the directivity control data for each channel for a basic pattern for controlling the directivity of each channel of the input multi-channel audio signals in separate directions, the basic pattern for multi-channel audio signals including at least one of:

center-channel directivity control data for controlling the directivity of an audio signal of a center channel to cause the audio signal of the center channel to be output toward a listening position;

front-channel directivity control data for controlling the directivity of an audio signal of a front channel to cause the audio signal of the front channel to be reflected on a left side wall or a right side wall and reach the listening position; or surround-channel directivity control data for controlling the directivity of an audio signal of a surround channel to cause the audio signal of the surround channel to be reflected on the left side wall or the right side wall and a rear wall and reach the listening position;

a pattern storage device that stores the basic pattern and a deformed pattern that assigns directivity control data for different channels to some or all of the channels of the input multi-channel audio signals using the directivity data for the basic pattern;

a pattern selector that selects the basic pattern or the deformed pattern; and a controller that sets the directivity control data to the directivity controller based on the pattern selected by the pattern selector, wherein, when the pattern selector selects the deformed pattern, the controller sets the directivity of the audio signal of at least one of the channels using the directivity control data of the basic pattern of another of the channels that is different from the at least one one channel, wherein when the multi-channel audio signals are input in each of the channels, a sound directivity of sound output by the array speaker differs from a first case, where the directivity of the multi-channel audio signals is controlled based on the basic pattern, and a second case, where the directivity of the multi-channel audio signals is controlled based on the deformed pattern.

2. The audio reproduction apparatus according to claim 1, wherein the channels of the multi-channel audio signals include at least a center channel, front left and right channels, and surround left and right channels.

3. The audio reproduction apparatus according to claim 1, wherein:

the directivity control data storage device stores at least the center-channel directivity control data and the front-channel directivity control data;

when the deformed pattern is selected by the pattern selector, the controller sets:

the directivity of the audio signal of the center channel using the center-channel directivity control data of the basic pattern;

the directivity of the audio signal of the front channel using the center-channel directivity control data or a preset fixed value thereof of the basic pattern; and the directivity of the audio signal of the surround channel using the front-channel directivity control data of the basic pattern.

4. The audio reproduction apparatus according to claim 1, wherein:

the directivity control data storage device stores at least the center-channel directivity control data and the front-channel directivity control data;

when the deformed pattern is selected by the pattern selector, the controller sets:

the directivity of the audio signal of the center channel using the center-channel directivity control data of the basic pattern;

the directivity of the audio signal of the front channel using the front-channel directivity control data of the basic pattern; and the directivity of the audio signal of the surround channel using the front-channel directivity control data of the basic pattern.

5. The audio reproduction apparatus according to claim 1, wherein:

the directivity control data storage device stores at least the center-channel directivity control data;

when the deformed pattern is selected by the pattern selector, the controller sets:

the directivity of the audio signal of the center channel using the center-channel directivity control data of the basic pattern; and the directivity of the audio signal of the front channel and the audio signal of the surround channel using the center-channel directivity control data or a preset fixed value thereof of the basic pattern.

6. The audio reproduction apparatus according to claim 1, wherein:

the directivity control data storage device stores at least the center-channel directivity control data;

when the deformed pattern is selected by the pattern selector, the controller mixes down the audio signal of the center channel and the audio signal of the surround channel of the basic pattern to 2-channel audio signals of the front channel and sets the directivity of the mixed-down audio signals using the center-channel directivity control data or a preset fixed value thereof of the basic pattern.

7. A directivity control method for an audio reproduction apparatus comprising:

an array speaker including a plurality of speaker units in a matrix or line arrangement;

a directivity controller that controls directivity of an audio signal of each channel of input multi-channel audio signals in an independent direction of each other based on directivity control data set to each channel; and a directivity control data storage device that stores the directivity control data of each channel for a basic pattern for controlling the directivity of each channel of the input multi-channel audio signals in separate directions, including at least:

center-channel directivity control data for controlling the directivity of an audio signal a center channel to cause the audio signal of the center channel to be output toward a listening position; and front-channel directivity control data for controlling the directivity of an audio signal of the front channel to cause the audio signal of the front channel to be reflected on a left side wall or a right side wall and reach the listening position;

a pattern storage device that stores the basic pattern and a deformed pattern that assigns directivity control data for different channels to some or all of the channels of the input multi-channel audio signals using the directivity data for the basic pattern; and a pattern selector that selects the basic pattern or the deformed pattern, wherein the directivity controller independently controls the directivity of each of the multi-channel audio signals and inputs the multi-channel audio signals to the array speaker, the method comprising the steps of:

selecting the deformed pattern;

controlling the directivity of the audio signal of the center channel using the center-channel directivity control data of the basic pattern;

controlling the directivity of the audio signal of the front channel using the center-channel directivity control data or a preset fixed value thereof of the basic pattern; and controlling the directivity of the audio signal of the surround channel using the front-channel directivity control data of the basic pattern.

8. A directivity control method for an audio reproduction apparatus comprising:

an array speaker including a plurality of speaker units in a matrix or line arrangement;

a directivity controller that controls directivity of an audio signal of each channel of input multi-channel audio signals in an independent direction of each other based on directivity control data set to each channel; and a directivity control data storage device that stores the directivity control data of each channel for a basic pattern for controlling the directivity of each channel of the input multi-channel audio signals in separate directions, including at least:

center-channel directivity control data for controlling the directivity of an audio signal a center channel to cause the audio signal of the center channel to be output toward a listening position; and front-channel directivity control data for controlling the directivity of an audio signal of the front channel to cause the audio signal of the front channel to be reflected on a left side wall or a right side wall and reach the listening position;

a pattern storage device that stores the basic pattern and a deformed pattern that assigns directivity control data for different channels to some or all of the channels of the input multi-channel audio signals using the directivity data for the basic pattern; and a pattern selector that selects the basic pattern or the deformed pattern, wherein the directivity controller independently controls the directivity of each of the multi-channel audio signals and inputs the multi-channel audio signals to the array speaker, the method comprising the steps of:

selecting the deformed pattern;

controlling the directivity of the audio signal of the center channel using the center-channel channel directivity control data of the basic pattern;

controlling the directivity of the audio signal of the front channel using the front-channel directivity control data of the basic pattern; and controlling the directivity of the audio signal of the surround channel using the front-channel directivity control data of the basic pattern.

9. A directivity control method for an audio reproduction apparatus comprising:

an array speaker including a plurality of speaker units in a matrix or line arrangement;

a directivity controller that controls directivity of an audio signal of each channel of input multi-channel audio signals in an independent direction of each other based on directivity control data set to each channel; and a directivity control data storage device that stores the directivity control data of each channel for a basic pattern for controlling the directivity of each channel of the input multi-channel audio signals in separate directions, including at least one of:

center-channel directivity control data for controlling the directivity of an audio signal a center channel to cause the audio signal of the center channel to be output toward a listening position;

front-channel directivity control data for controlling the directivity of an audio signal of the front channel to cause the audio signal of the front channel to be reflected on a left side wall or a right side wall and reach the listening position; or surround-channel directivity control data for controlling the directivity of an audio signal of the surround channel to cause the audio signal of the surround channel to be reflected on the left side wall or the right side wall and a rear wall and reach the listening position;

a pattern storage device that stores the basic pattern and a deformed pattern that assigns directivity control data for different channels to some or all of the channels of the input multi-channel audio signals using the directivity data for the basic pattern; and a pattern selector that selects the basic pattern or the deformed pattern, wherein the directivity controller independently the directivity of each of the multi-channel audio signals and input the multi-channel audio signals to the array speaker, the method comprising the steps of:

selecting the deformed pattern;

controlling the directivity of the audio signal of the center channel using the center-channel directivity control data of the basic pattern; and controlling the directivity of the audio signal of the front channel and the audio signal of the surround channel using the center-channel directivity control data or a preset fixed value thereof of the basic pattern.

10. A directivity control method for an audio reproduction apparatus comprising:

an array speaker including a plurality of speaker units in a matrix or line arrangement;

a directivity controller that controls directivity of an audio signal of each channel of input multi-channel audio signals in an independent direction of each other based on directivity control data set to each channel; and a directivity control data storage device that stores the directivity control data of each channel for a basic pattern for controlling the directivity of each channel of the input multi-channel audio signals in separate directions, including at least one of:

center-channel directivity control data for controlling the directivity of an audio signal a center channel to cause the audio signal of the center channel to be output toward a listening position;

front-channel directivity control data for controlling the directivity of an audio signal of the front channel to cause the audio signal of the front channel to be reflected on a left side wall or a right side wall and reach the listening position; and surround-channel directivity control data for controlling the directivity of an audio signal of the surround channel to cause the audio signal of the surround channel to be reflected on the left side wall or the right side wall and a rear wall and reach the listening position;

a pattern storage device that stores the basic pattern and a deformed pattern that assigns directivity control data for different channels to some or all of the channels of the input multi-channel audio signals using the directivity data for the basic pattern; and a pattern selector that selects the basic pattern or the deformed pattern, wherein the directivity controller independently controls the directivity of each of the multi-channel audio signals and inputs the multi-channel audio signals to the array speaker, the method comprising the steps of:

selecting the deformed pattern;

mixing down the audio signal of the center channel and the audio signal of the surround channel to 2-channel audio signals of the front channel; and controlling the directivity of the mixed-down audio signals using the center-channel directivity control data or a preset fixed value thereof of the basic pattern.

* * * * *